United States Patent [19]

Fuhr

[11] 3,993,228

[45] Nov. 23, 1976

[54] HOSIERY DONNING APPARATUS

[76] Inventor: Leo Fuhr, 2004-1200 Alberni St., Vancouver, British Columbia, Canada, V6E 1A6

[22] Filed: Dec. 29, 1975

[21] Appl. No.: 644,394

[52] U.S. Cl. ..... 223/111
[51] Int. Cl.[2] ..... A47J 51/06
[58] Field of Search ..... 223/111, 114

[56] References Cited

UNITED STATES PATENTS

| | | | |
|---|---|---|---|
| 916,508 | 3/1909 | Vietor | 223/111 |
| 1,315,096 | 9/1919 | Dieley | 223/111 |
| 3,231,160 | 1/1966 | Glanville | 223/111 |

*Primary Examiner*—George H. Krizmanich
*Attorney, Agent, or Firm*—Townsend and Townsend

[57] ABSTRACT

Apparatus for putting on hosiery when physical disability will not allow normal procedures to be followed includes an elongated handle fitted to a tiltable foot plate. An upper end of the handle is held by the handicapped person initially to hold the plate beneath the sole of his foot. Spaced hooks are provided on the plate to support the top of a sock open around the toes whereupon the handle is raised to pull the sock onto the foot. As this is done, means on the handle allow the foot plate to be tilted to pass behind the heel. The handle carries other means operable from the upper end of the handle to release the sock when the plate is fully tilted and the sock is completely on the foot.

7 Claims, 6 Drawing Figures

73
75
72
70
38
39
53
3
2
1
14
18
50
51
10
58
34
62
12
83
20
61
63
32
60
85
54
42
16
77
45
80
22
82
31
30

HOSIERY DONNING APPARATUS

My invention relates generally to mechanical aids for handicapped persons and more particularly to a device which will provide assistance to a person who lacks the mobility needed to put on his socks in a normal manner.

There are a number of men and women who suffer from arthritis or other disabilities which prevent them from bending at the waist or flexing their legs as must be done when hosiery is to be donned. Mechanical applicators have been suggested to assist such people in this task but known devices of this nature have disadvantages which may explain why they are not used more extensively. For example, some conventional applicators are heavy and awkward to manipulate so that they call for a degree of strength and dexterity which many handicapped people do not have. A person with ankles which are locked by some disease or injury may find it difficult to get a sock over his foot using a mechanical applicator and so will someone with only limited use of his hands.

I overcome such disadvantages by providing apparatus which is simply and lightly constructed so that it can be manipulated by one hand. The apparatus has mechanical parts which will hold a sock and allow it to be pulled over the foot and up the ankle even though that joint may be quite rigid. All the required movements of the parts are accomplished by the fingers and thumb of one hand as the apparatus is pulled upwardly by the arm.

More specifically, the present invention contemplates a hosiery donning apparatus which comprises a plate, a handle, pivot means securing the plate to an end of the handle for swinging movement between a normal position and a tilted position, holding means on the plate for releasably supporting a top of the sock open to receive the toes when the plate is held substantially parallel to the underside of the foot, and tilting means on the handle remote from the plate for swinging said plate to the tilted position as the sock is pulled over the foot and up the ankle.

Figures 1, 2:
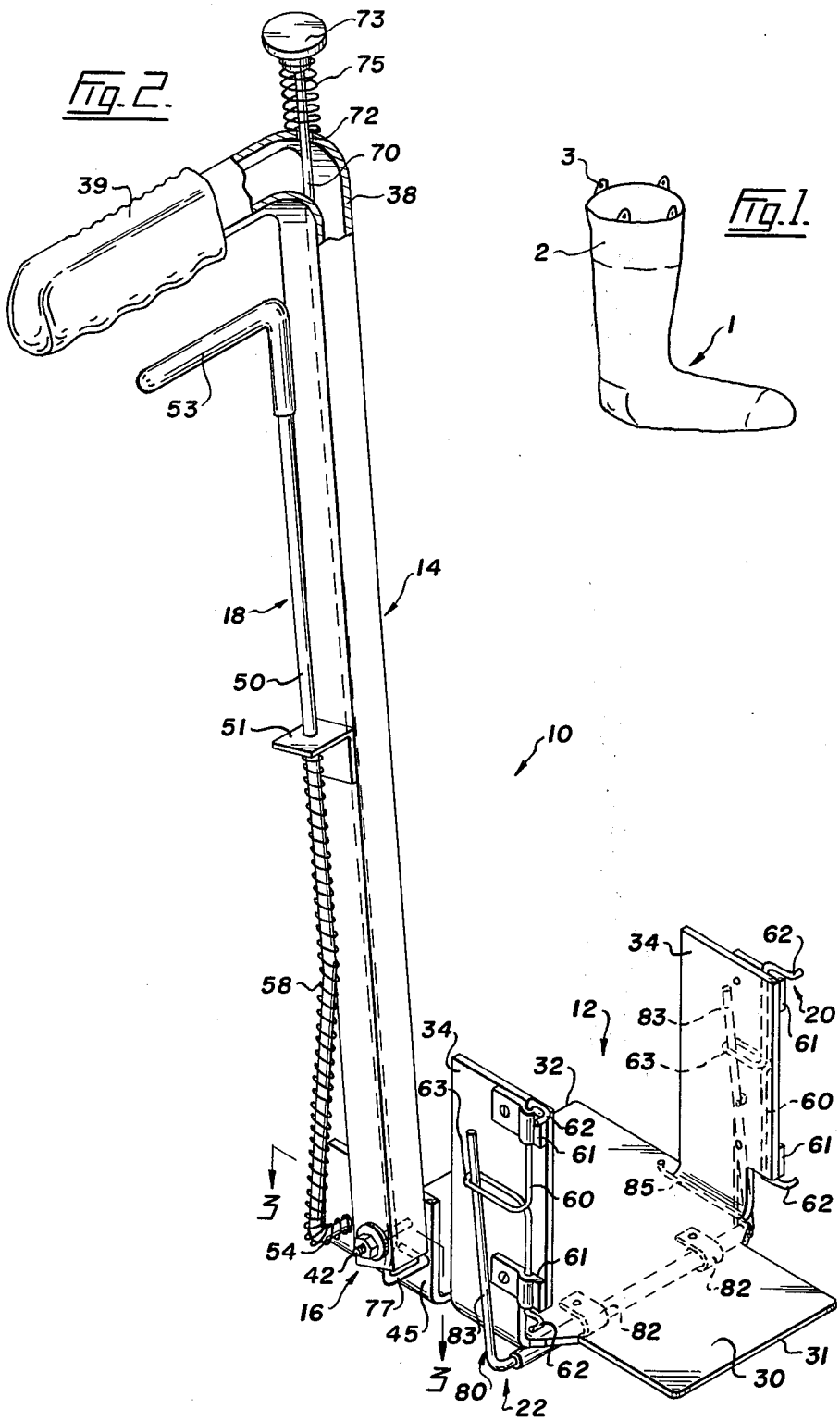
Figure 3:
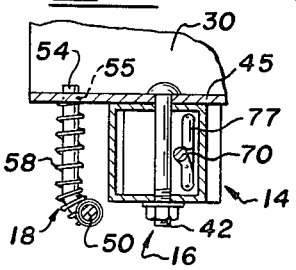
Figure 5:
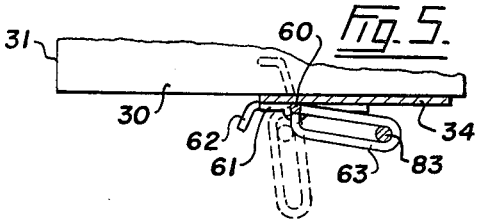
Figure 4:
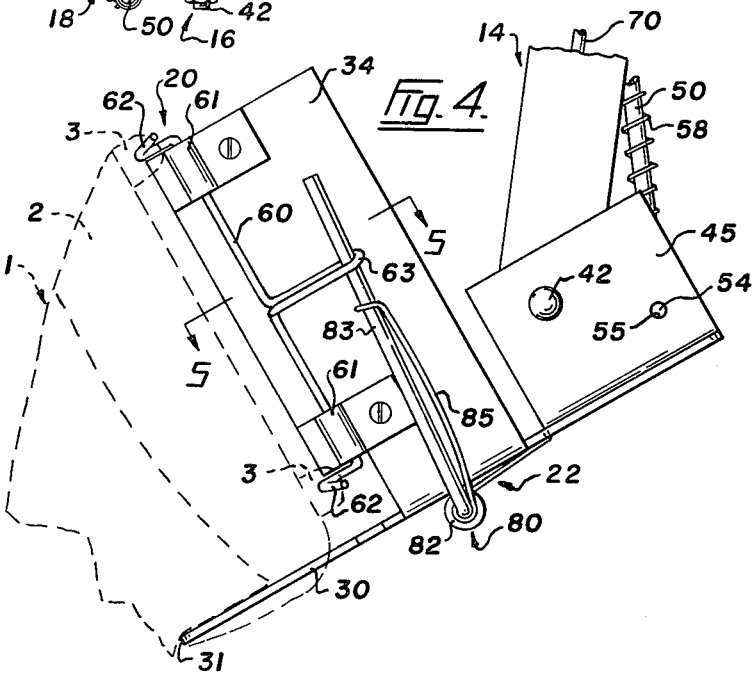
Figure 6:
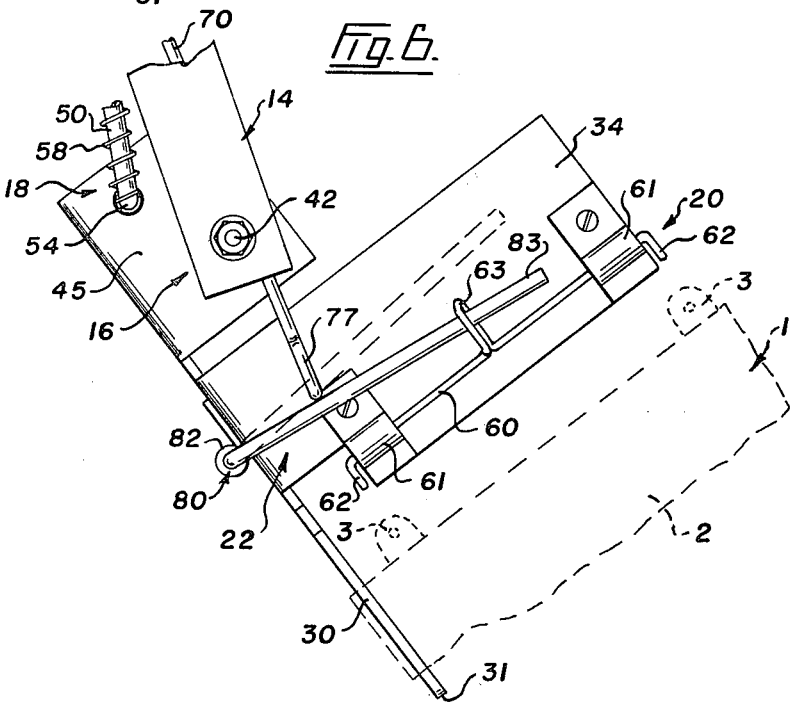

In drawings which illustrate a preferred embodiment of the invention,

FIG. 1 is a perspective view of a sock modified so that it can be placed on the foot by the present invention, FIG. 2 is a perspective view showing a sock donning apparatus constructed in accordance with the present invention, FIG. 3 is an enlarged horizontal section taken on the line 3—3 of FIG. 2 and showing a preferred pivot means of the apparatus, FIG. 4 is a side elevation, part broken away, showing a base plate of the apparatus in tilted position, FIG. 5 is a horizontal section taken on the line 5—5 of FIG. 4, and FIG. 6 is a side elevation, part broken away, and showing the sock-releasing action of the apparatus.

The present apparatus may be used by women who wear thigh-length hose but it is better adapted for use by men. In FIG. 1, there is shown a man's sock 1 having an upper end 2 which I prefer to provide with fabric eyelets 3. These eyelets make it easier to attach the sock to the present apparatus although they are not absolutely essential since the device has sock-engaging members which can be threaded through the reinforced upper end 2 of hose for men or women.

Referring now to FIG. 2 of the drawing, the numeral 10 indicates generally a hosiery donning apparatus which forms a basis of the present invention. The apparatus 10 comprises a foot plate 12 which is attached to a handle 14 by pivot means 16. The handle carries means 18 for tilting the plate about a transverse axis. On the plate 12, there is provided means 20 for holding a sock open and in a position to receive the foot. To release the sock onto the foot, the apparatus is provided with means which is indicated generally by the numeral 22.

The foot plate generally indicated at 12 is shown to be formed on sheet material, preferably aluminum or plastic which is light in weight and strong. This substantially rectangular plate 12 has a front portion 30 of a lesser width and this portion has an edge 31 parallel to rear edge 32. Upturned sides of the base provide the plate 12 with posts 34 which are disposed to the rear of the portion 30.

Preferably, the handle generally indicated at 14 is also formed of square aluminum or plastic tubing. Upper end 38 of the handle is bent at 90° to provide a suitably covered hand grip 39.

The pivot means generally indicated at 16 is shown to comprise a bolt 42 which extends transversely through an open lower end of the handle, see FIGS. 1 and 3. Bolt 42 projects through a vertical flange 45 provided on the plate to the rear of one of the posts 34. Thus, the foot plate 12 is pivotly mounted on the handle and can be rocked about the axis of the bolt 42 to raise and lower the front edge 31. FIG. 2 shows a foot plate in a normal or raised position relative to the handle 14. In FIG. 4 the foot plate is shown at a maximum angle of tilt with respect to the handle at which time the front edge 31 is considerably below the rear edge 32.

The tilting means generally indicated at 18 provides the mechanism required to change the downward slope of the foot plate. This tilting mechanism 18 is shown to comprise a rod 50 which is slidably mounted in a bracket 51 carried by the side of the handle. A major part of this rod extends parallel to the handle but a suitably covered finger grip 53 is provided on the upper end of said rod and this finger grip is located immediately below and close to the parallel hand grip 39. The lower end 54 of the rod 50 is laterally turned to project through an opening 55 (see FIG. 3) in the flange 45 above and to the rear of the pivot bolt 42. This arrangement allows the plate 12 to be inclined downwardly to the tilted position when the rod is pulled upwardly and to be returned to its original or raised position when the rod is again lowered.

A spring 58 is provided to bias the foot plate towards the raised position. This compression spring 58 is wound around the rod 50 between the bracket 51 and the inturned end 54 of the rod. The force needed to compress the spring 58 is not too great and can readily be exerted by finger pressure applied by the handle on the grip 39.

The holding means generally indicated at 20 can best be seen in FIGS. 2, 4 and 5 as comprising a length of stiff wire 60 which is mounted on the outer face of each post 34. Bearings 61 journal the two wires for rotation about axes perpendicular to the top surface of the foot plate 12. The opposite ends of the wires 60 are shaped to provide hooks 62. Intermediate parts of the wire are formed into loops 63. Both the hooks and loops are positioned to swing in planes substantially parallel to the top surface of the plate 12.

The four widely spaced hooks 62 are adapted to engage and grip the eyelets 3 on the socks when the hooks project outwardly of the post 34. As this time, the loops 63 are alongside the posts projecting to the rear of the plate. When the loops are swung forwardly, the hooks 62 are moved to the dotted line positions shown in FIG. 5 whereupon the eyelets 3 are disengaged by the hooks.

Releasing means 22 comprise a plunger 70 which is slidably mounted in the hollow handle 14. An upper end of this plunger projects through an opening 72 (see FIG. 2 only) in the handle and the plunger end is fitted with a thumb rest 73. A spring 75 is interposed between the rest 73 and the handle end normally to resist downward movement of the plunger. The plunger 70 has a lower end which projects from the corresponding open-end of the handle and which is shaped to provide a transversely extending presser bar 77.

Included in the releasing means 22 is a U-shaped rod 80 which is journalled in transversely aligned bearings 82 provided on the underside of the plate 12. This rod has side portions 83 extending parallel to the posts 34 and slidably projecting through the loops 63. A spring 85, see particularly FIG. 4, is fitted to the rod 80 to hold the rod portions 83 against the rear or rounded ends of the loops 63.

A person wishing to put on a sock 1 using the hosiery donning apparatus 10 first attaches the sock to the foot plate as follows. The top 2 of the sock is spread open so that the eyelets 3 can be threaded onto the hooks 62 as shown in FIG. 4. The remainder of the sock is allowed to hang downwardly over the plate portion 30 to be suspended from the edge 31 with the toe of the sock projecting forwardly. At this time, the front portion 30 of the plate cooperates with the hooks 62 to hold the upper end or top 2 of the sock open to receive the toes.

The user then holds the apparatus in one hand and employs it as an extension of his arm to enter the toes of one foot into the open end of the sock. At this time, the heel of the foot likely will be over the rear edge 32 of the plate and the plate itself will be substantially parallel to the sole of the foot. An upward pull is exerted on the handle and, at the same time, the grips 39 and 53 are squeezed together to raise the rod 50. These combined movements tilt the foot plate downwardly so that is swings around the heel to a position to the rear of the ankle as the sock is pulled up into position of wear. The thumb of the hand which holds the two grips is used on the rest 73 to depress the plunger 70 so that the member 77 is projected from the lower end of the handle. In FIG. 6 is will be seen that the presser bar 77 engages the adjacent side portion 83 of the U-shaped rod when the foot plate is tilted as described. Downward movement of the plunger 70 will then swing the rod 80 forward to operate the holding means 20. In other words, the wires which form the hooks are rotated in their bearings so that the hooks on opposite sides of the plate are moved towards one another and this movement releases the sock as shown in FIG. 6. Pressure is then taken off the finger grip 53 and the thumb rest 73 to allow the foot plate to return to its normal position and the holding means 20 to return to an original position whereupon the apparatus can be fitted with the other sock which is applied in the same manner.

From the foregoing, it will be apparent that I have provided an extremely effective device for putting on socks which can be operated by many severely handicapped people. The sock-donning action executed by the apparatus when operated as described places the socks on the feet by movements which are used by a normal or unhandicapped person. In other words, the ankle does not have to be bent so as to point the toes down to receive the sock. The ankle may be stiff and unbending but the sock is passed over the toes and then is fed around the heel and up the ankle by movements which simulate to some degree at least the hand movements of a normal person. The apparatus described is produced by a person having a reasonably good right hand for the purpose. The handle shown could just as readily be mounted on the opposite side of the foot plate for someone with a good left hand.

I claim:

1. Apparatus for assisting a handicapped person to place a sock on his foot comprising a plate, a handle, pivot means securing the plate to an end of the handle for swinging movement between a normal position and a tilted position, holding means on the plate for releasably supporting the top of the sock open to receive the toes when the plate is held substantially parallel to the underside of the foot, and tilting means on the handle remote from the plate for swinging said plate to the tilted position as the sock is pulled over the foot and up the ankle.

2. Apparatus as claimed in claim 1, and including spring means biasing the plate towards the normal position.

3. Apparatus as claimed in claim 1, and including releasing means on the handle for actuating the holding means to release the sock.

4. Apparatus as claimed in claim 3, in which said holding means includes a plurality of spaced sock gripping members mounted on the plate and operable to grip and release the sock, said releasing means including a plunger operable from near the top of the handle to move the members and release the sock when the plate is in the tilted position.

5. Apparatus as claimed in claim 3, in which said handle has an upper end, said tilting means including a rod having an upper end adjacent the upper end of the handle.

6. Apparatus as claimed in claim 4, in which said plunger has an upper end near the upper end of the handle and the rod.

7. Apparatus for assisting a handicapped person place a sock on his foot comprising an elongated handle having a hand-grip end and an opposite end, a plate having side posts and a front edge, pivot means securing the plate to the opposite end of the handle for swinging movement about an axis transverse to a longitudinal axis of said handle, tilting means on the handle for tilting the plate about the transverse axis, a plurality of hook members mounted on the post for swinging movement between sock-engaging and sock-disengaging positions, said hook members in their sock-engaging positions supporting a top of the sock open and disposed rearwardly of the front end of the plate, and releasing means on the handle for actuating the hook members to release the sock, said releasing means including a rod mounted for reciprocatory movement on the handle, said rod having a finger-grip end near the hand-grip and a pressing end near the plate, a motion-transmitting member mounted on the plate to engage the hook members, said pressing end and motion-transmitting member being moved into operative engagement when the plate is tilted by the tilting means.

* * * * *